United States Patent [19]

Kinkade

[11] 4,179,829

[45] Dec. 25, 1979

[54] TRENCHING MACHINE

[76] Inventor: Franklin C. Kinkade, R.R. #4, Creston, Iowa 50801

[21] Appl. No.: 859,796

[22] Filed: Dec. 12, 1977

[51] Int. Cl.[2] ..... E02F 5/08

[52] U.S. Cl. ..... 37/94; 37/189; 37/DIG. 2

[58] Field of Search ..... 37/94–97, 37/91, 189, 100, DIG. 2

[56] References Cited

U.S. PATENT DOCUMENTS

| | | | |
|---|---|---|---|
| 357,939 | 2/1887 | Plumb | 37/94 |
| 1,064,733 | 6/1913 | Horix | 37/97 |
| 1,199,366 | 9/1916 | French | 37/94 |
| 1,215,791 | 2/1917 | French | 37/94 |
| 1,472,563 | 10/1923 | Loken | 37/94 |
| 2,826,839 | 3/1958 | Kolbe | 37/97 UX |
| 2,896,342 | 7/1959 | Reising | 37/97 |

*Primary Examiner*—Clifford D. Crowder
*Attorney, Agent, or Firm*—Rudolph L. Lowell; G. Brian Pingel

[57] ABSTRACT

A high speed trenching machine has a rotatable digging unit with a rim assembly symmetrically constructed relative to a flat center ring member and includes an outer peripheral spoil receiving section comprised of a pair of side by side annular channel ways open to opposite sides of the digging unit and formed in the outer peripheral side walls thereof with a series of circumferentially spaced digging teeth arranged in a staggered relation in operative association with respective spoil receiving inlets. The circumferential extent of an inlet is less than the radial dimension of a channel way, the inner peripheral side wall of which is inclined away from the outer peripheral side wall thereof in a direction toward the channel way open side. The inner peripheral channel side wall and a gear segment are of an integral unit construction with the units being identical and secured to opposite sides of the flat center ring member so that the gear segments form a complete ring gear on each side of the rim member inwardly of and within the transverse confines of the spoil receiving section.

3 Claims, 6 Drawing Figures

TRENCHING MACHINE

BACKGROUND OF THE INVENTION

The excavating machines of the prior art generally include digging wheels having a series of circumferentially spaced buckets which usually have a transverse dimension appreciably greater than the dimension of the tile to be laid. The resulting extra ditch width is often necessary for machine clearance purposes but the extra power and time required in digging and filling the extra width ditch materially increases operational costs. Such type machines are generally disclosed in U.S. Pat. Nos. 1,064,733; 1,113,952; 1,199,366; 1,215,791; 2,730,821; 2,914,866 and 3,077,042. These machines generally operate with difficulty in hard or frozen ground due to the tendency of the buckets to ride on, rather than to penetrate into, the surface being worked on. This riding tendency results in appreciable bouncing of the machine and instability in its operation. Additionally, only a portion of the effective peripheral surface of the digging wheel is utilized for conveying spoil to the surface whereby the linear advance of the machine in a digging operation takes place at a relatively slow rate of speed.

The digging machine of U.S. Pat. No. 3,412,490 is constructed for the high speed digging of a narrow ditch for the laying of cables and the like of small diameter with the disposition of the spoil being to each side of the ditch. However, the volume capacity of the machine for handling spoil is necessarily limited by the open spiral arrangement of the digging teeth about the peripheral surface of the digging wheel. The trenching machine of Radahl Industries of Rakkestad, Norway, as disclosed in literature therein, has a digging wheel with a single circular channel way open to one side of the wheel with the outer peripheral side wall of the channel being comprised of a plurality of circumferentially arranged curved segments, the adjacent ends of which are spaced apart radially of the wheel to form spoil receiving inlets. This machine performs well in both hard and soft terrain and is capable of digging a narrow trench. However, since spoil is carried only on one side of the wheel, the rate of travel of the digging operation and the depth of the ditch being dug are limited.

U.S. Pat. No. 3,680,919 discloses a digging wheel adapted for digging in both hard and soft terrain by the provision of a relatively large number of buckets and the use of detachably mounted weight members for selectively controlling the inertia of the digging wheel.

SUMMARY OF THE INVENTION

The trenching machine of this invention is capable of digging in both soft and hard terrain at a high rate of speed and at an appreciable depth. The digging wheel is of a symmetrical construction relative to a flat continuous center ring member that forms part of a double wheel assembly, each of which includes a continuous annular channel way open to one side of the digging wheel and circumferentially offset spoil receiving inlets in the outer peripheral wall of each channel way. The overall transverse dimension of the digging wheel is only slightly larger than the dimension of the tile or conduit to be laid. The offset or staggered arrangement of the spoil receiving inlets in combination with the pair of spoil receiving channels provides for a free continuous high volume flow of spoil into the digging wheel and a discharge therefrom to opposite sides of the trench being dug. As a result, the digging unit can be rotated at high speed resulting in a rapid trenching operation with a minimum of effort and expense. Since the provision of a relatively narrow digging unit requires less power it can be used with a light weight machine while maintaining a high operating efficiency. The spoil inlet arrangement substantially eliminates any bouncing of the machine during hard terrain operation so that a reduction in weight of the machine can be made while maintaining operational stability.

DESCRIPTION OF THE INVENTION

Figure 1:
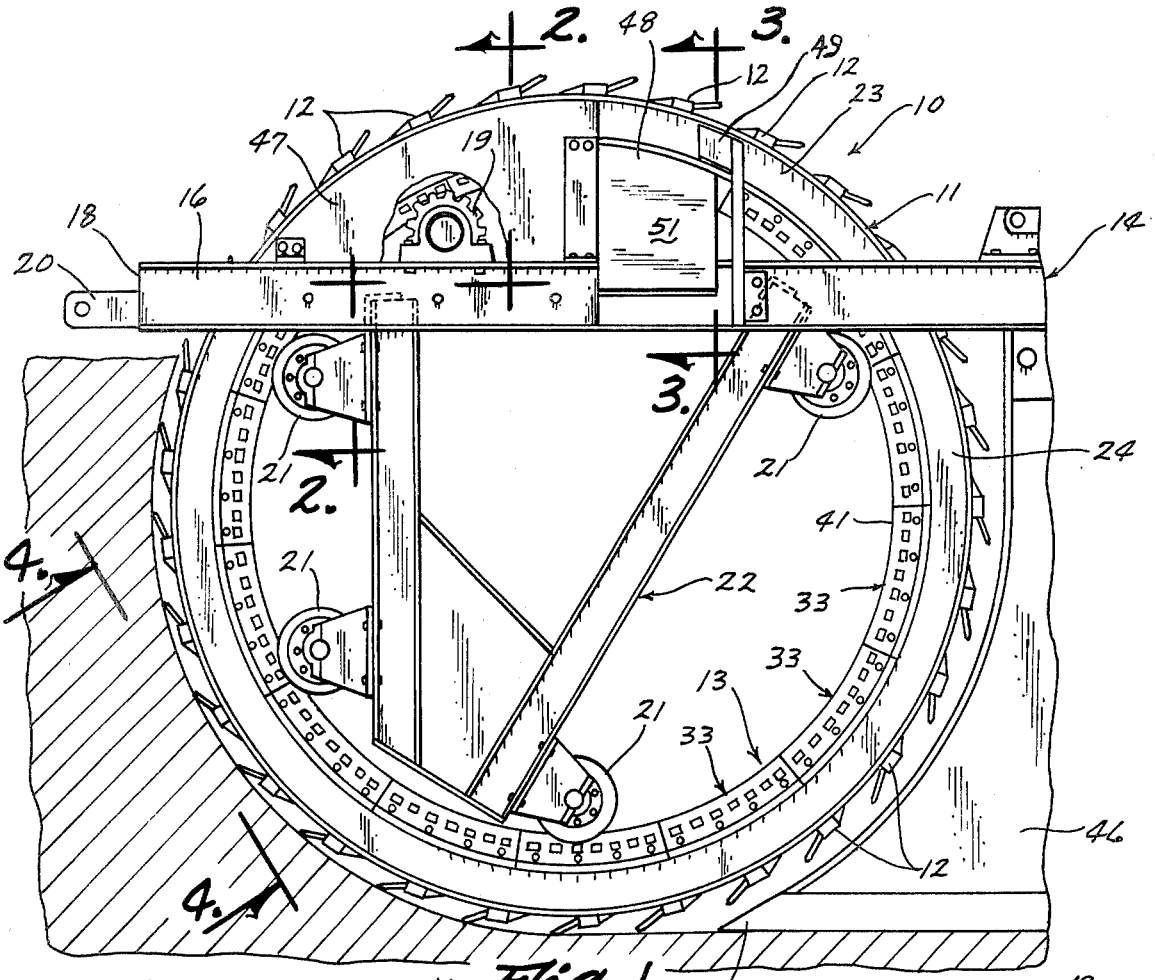
FIG. 1 is a side elevational view of the excavating machine of this invention.

The trenching or digging wheel of this invention, indicated generally in FIG. 1 as 10, includes a rim structure 11 having sets of digging teeth 12 mounted about its outer periphery and a pair of oppositely arranged gear rings 13 (only one of which is shown in FIG. 1) about its inner periphery. The wheel 10 is supported by a main frame 14 which includes beams 16 and 17 spaced at each side of the wheel 10 and having forward terminal ends 18 connectible by a hitch 20 for support and towing by a suitable tractor or the like (not shown). The beams 16 and 17 are located above the wheel axis, as shown in FIG. 1, and adjacent their forward ends 18 (FIGS. 1 and 2) rotatably support a pair of gear members 19 which are in driving engagement with respective ones of the gear rings 13. The gears 19 are suitably driven from a power unit (not shown) on the supporting and towing tractor. The digging wheel 10 is rotatably supported at its inner periphery on circumferentially spaced rollers 21 which are rotatably mounted on a frame assembly 22 suspended from the beam members 16 and 17.

Figure 2:
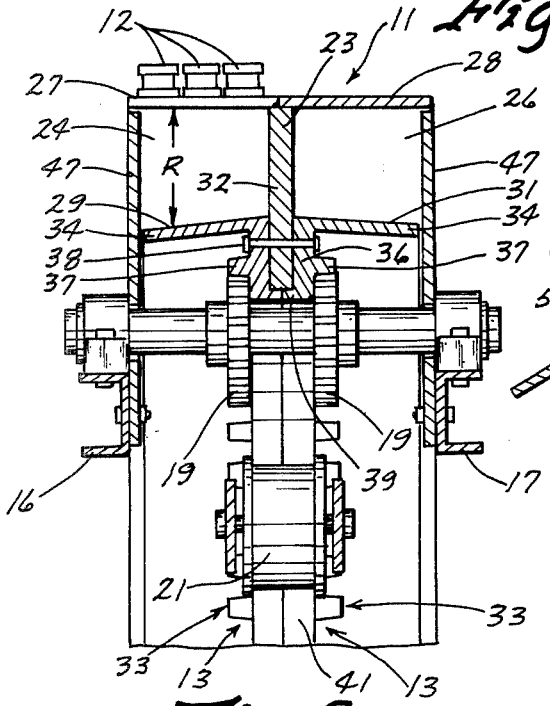
FIG. 2 is an enlarged detail sectional view taken along the line 2—2 in FIG. 1.
Figure 3:
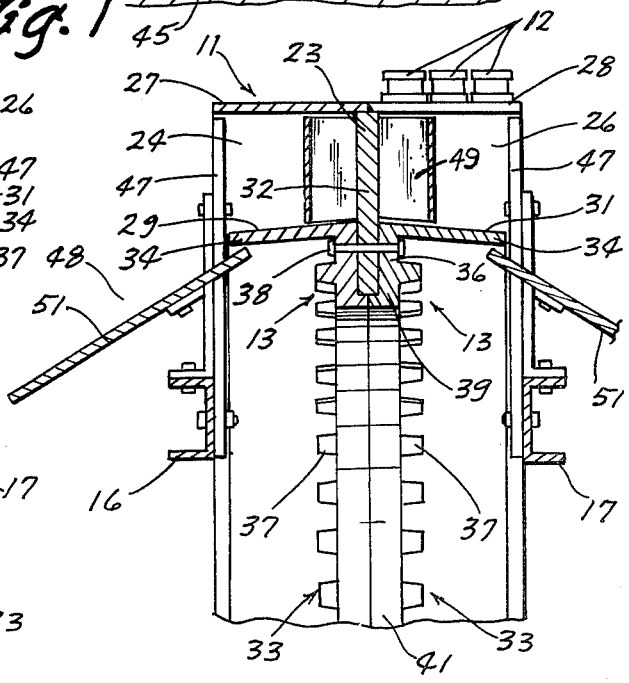
FIG. 3 is an enlarged sectional detail view as seen along the line 3—3 in FIG. 1.

Referring to FIGS. 2 and 3, it is seen that the rim structure 11 is of a symmetrical construction relative to a continuous flat annular center ring member 23 and includes a pair of transversely opposite annular channel ways or spoil receiving sections 24 and 26 which are open to opposite sides of the digging wheel 10. Each channel 24 and 26 has an outer peripheral side wall 27 and 28, respectively, and inner peripheral side walls 29 and 31, also respectively. A common base wall 32 is formed by the center ring member 23, the medial transverse plane of which constitutes the plane of symmetry for the digging wheel 10. The outer side walls 27 and 28 are arranged in a side by side relation for securement of adjacent sides thereof, as by weldments, to the outer peripheral surface of the ring member 23.

The inner peripheral walls 29 and 31 of the channels 24 and 26, respectively, form part of an arcuate unit or body member 33 (FIGS. 5 and 6) of a one piece construction having an angular shape in transverse cross section. A long leg member 34 of each arcuate unit 33

(FIGS. 2 and 6) forms the inner peripheral walls 29 and 31 for the respective channels 24 and 26 while a short leg member 36 includes a gear segment 37 to form a gear ring 13.

The arcuate units 33 are of an identical construction so as to be positionable against either side of the center ring member 23. When the arcuate units 33 (FIGS. 2 and 3) are positioned to opposite sides of the ring member 23, with the long leg members 34 projected laterally from the ring member, oppositely arranged ones of the units 33 are secured together and to the ring member 23 by bolt assemblies 38 which are insertable through aligned holes formed in the ring member 23 and the arcuate units 33. The terminal ends 39 of the short leg members 36 are laterally extended to overlap or cover the peripheral surface of the ring member 23, when the arcuate units 33 are clamped against the opposite sides of the ring member 23. These terminal ends 39 form a continuous wear ring or annular bearing surface 41 for coacting engagement with the rollers 21 to rotatably support the digging wheel 10. It is seen, therefore, that the ring member 23 and channel outer walls 27 and 28 form a one-piece unit to which is secured the one-piece arcuate units 33 whereby to provide an overall rigidity to the digging wheel 10.

Figure 4:
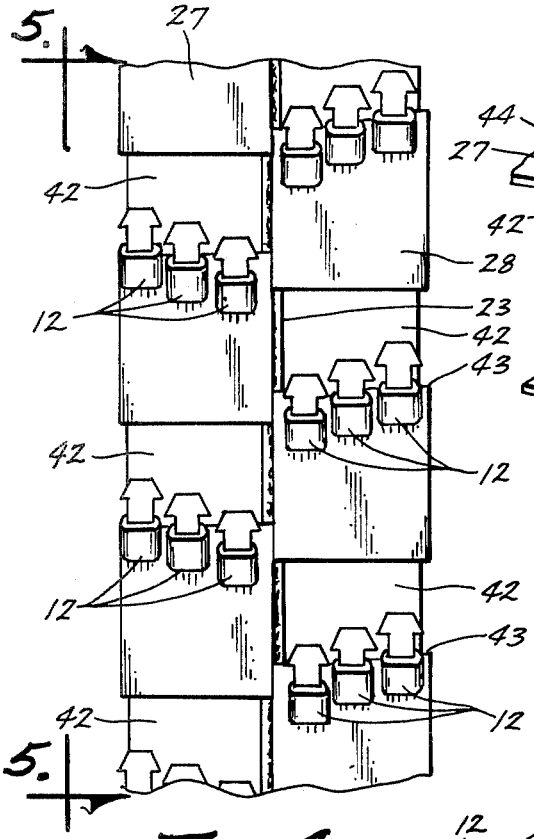
FIG. 4 is a fragmentary elevational view of the digging wheel showing the arrangement thereon of an array of digging teeth.
Figure 6:
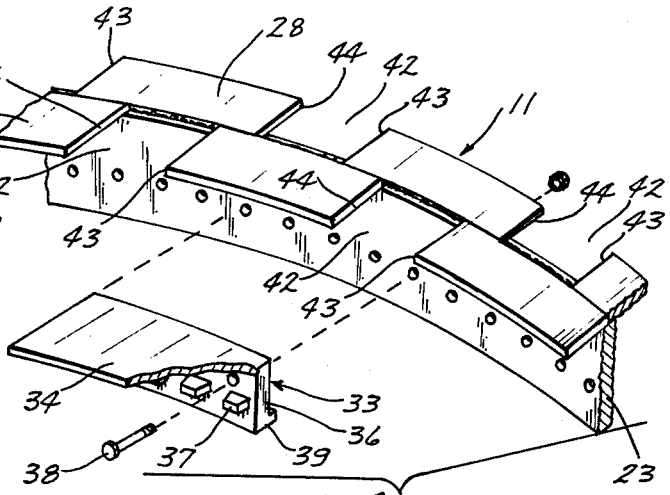
FIG. 6 is a fragmentary exploded perspective view of the digging wheel.
Figure 5:
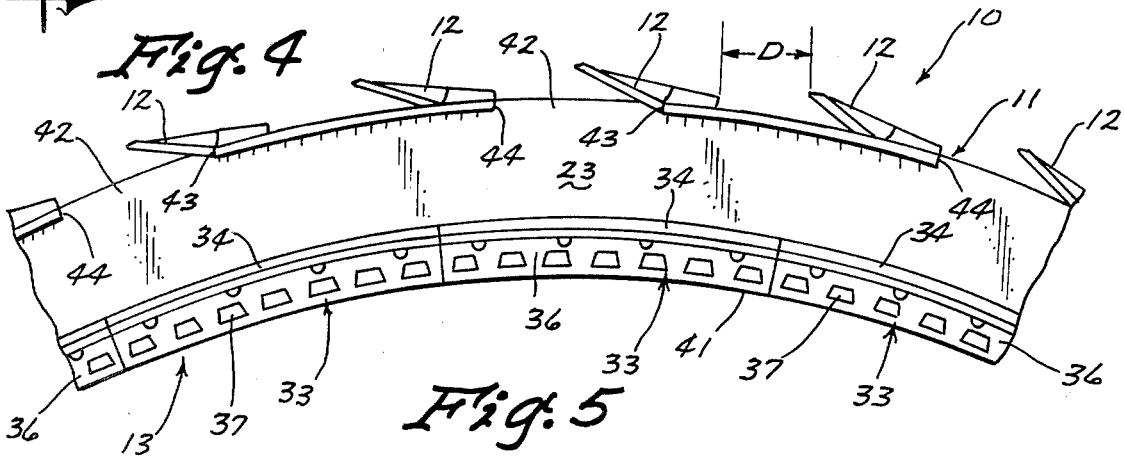
FIG. 5 is an enlarged side elevational view of the digging wheel as seen along the line 5—5 in FIG. 4.

Each of the outer walls 27 and 28 of the channels 24 and 26, respectively, is formed with a plurality of circumferentially spaced spoil receiving inlets 42 corresponding in number to the sets of digging teeth 12 (FIGS. 4, 5 and 6). It is to be noted that the spoil inlets 42 for the channel ways 24 and 26 are alternately circumferentially offset so that the inlets 42 are arranged in a staggered relation about the wheel 10. The digging teeth 12 to each side of the wheel 10, therefore, operate alternately in a digging operation and in conjunction with their relatively short circumferential spacing about the wheel 10 function effectively, at a high speed rotation of the wheel, in either hard or soft terrain without effecting any appreciable bouncing movement or instability in the digging machine.

Each set of digging teeth 12 is mounted on an outer channel wall 27 and 28 at the trailing end 43 (FIGS. 4 and 5) of a spoil inlet at positions providing for the projection thereof over a respective inlet in a direction toward the leading end 44 of the inlet. The extent of projection of a set of digging teeth 12 over an adjacent inlet 42 is a proportional amount of the circumferntial length of an inlet 42 such that the distance indicated at D in FIG. 5 is less than the radial distance R (FIG. 2) between the inner and outer side walls of a channel 24 and 26. It is thus seen that material permitted to pass through a spoil inlet 42 is of a size to be readily received within a channel 24 and 26 during a digging operation. As a result, blocking of a channel by a rock, clod or the like, is completely eliminated so that a channel is always free and open to receive material from an inlet 42.

It is to be further noted that the arrangement of the sets of digging teeth 12 may be modified or varied to provide a ditch bottom wall of a desired contour to accommodate different types and size of tile. As illustrated in FIG. 4, the digging teeth 12, corresponding to the channels 24 and 26, are relatively arranged to form a ditch having a bottom of a concave shape in transverse section. It is to be understood that the leading end 45 of the crumber 46 (FIG. 1) can also be changed to conform with the cutting arrangement of the digging teeth 12.

In the operation of the excavating machine, and on rotation of the digging wheel 10 and its advance movement by a towing tractor, spoil is successively removed by the diging teeth 12 and directed into an adjacent inlet 42 for passage into a channel 24 and 26. During travel of the wheel within the ditch the spoil is retained within the channels 24 and 26 by the ditch side walls after which said retention is maintained by retaining plates 47 mounted on the main frame 14 to opposite sides of the digging wheel 10 (FIGS. 1, 2 and 3). As best shown in FIGS. 2 and 3, the retaining plates 47 are positioned within the transverse confines of the rim structure 11 and in a clearance relation with the free ends of the inner peripheral walls 29 and 31, to a position adjacent the spoil dumping zone or station 48.

A scraper or cleaning unit 49 is associated in a usual manner with each channel 24 and 26 for removing and directing the dirt therefrom onto an associated deflecting plate 51 for discharge to the ground to opposite sides of the ditch being formed. As shown in FIG. 3, a deflecting plate 51 is inclined downwardly and outwardly from a position adjacent to and below the free end of the short leg member 36 of the arcuate units 33. To facilitate the removal of spoil from the channels 24 and 26, each of the long legs 34 which form the inner peripheral walls 29 and 31 for the channels 24 and 26, respectively, is inclined from the side thereof adjacent the ring member 23 away from an associated outer peripheral wall 27 and 28, also respectively, in a direction toward the open side of a channel. Stated otherwise, the open or discharge side of a channel 24 and 26 has a dimension radially of the wheel 10 greater than the corresponding dimension of the base side 32 so as to eliminate any plugging or obstruction to a free travel of spoil outwardly from a channel at the discharge zone 48.

Although the invention has been described with reference to a preferred embodiment thereof, it is to be understood that it is not to be so limited since changes and alterations can be made therein within the intended scope of the invention as defined in the appended claims.

I claim:

1. In an excavating machine including:

(a) a main frame, (b) a digging unit mounted on the main frame for rotational movement including a rim structure with an outer peripherally extended spoil receiving section comprised of a pair of back to back channel members open to opposite sides of the digging unit with the leg sections thereof opposite each other transversely of said rim structure so that radially opposite portions of said leg sections are uniformly spaced radially of said rim structure over the circumferential length thereof, (c) each outer peripheral leg section of a channel member formed with circumferentially spaced spoil receiving inlets, (d) digging means for each inlet secured to each outer peripheral leg section at the trailing end of the associated inlet so as to extend into the inlet toward the leading end thereof, (e) said digging means having the leading end thereof spaced a distance from the leading edge of the inlet associated therewith a distance less than the radial spacing between the leg sections of said channel members and (f) scraper elements mounted on said frame structure to remove spoil from said channel members on rotational movement of the digging unit.

2. In an excavating machine including:

(a) a main frame, (b) a rotatable digging unit mounted on said main frame having a symmetrically formed rim structure including a flat ring member defining the plane of symmetry, (c) a circumferentially extended spoil receiving section having an outer side wall secured to the outer peripheral surface of said ring member and projected laterally outwardly from opposite sides of said ring member, (d) a plurality of like arcuate units secured to opposite sides of said ring member to form a continuous circle of arcuate units on each side of the ring member, (e) each arcuate unit including an inner wall member having one side edge thereof positioned against a respective side of the ring member, and projected laterally from said respective side, in an underlying relation with the outer side wall to form a continuous inner side wall for said spoil receiving section, (f) said outer wall, and said inner wall having opposite portions thereof uniformly spaced apart radially of said ring member over the circumferential lengths thereof, said outer wall to each side of the ring member having a series of circumferentially spaced spoil receiving inlets, and (g) digging teeth for each spoil receiving inlet.

3. The excavating machine according to claim 2, wherein:

(a) the spoil receiving inlets in said outer side wall are arranged in a staggered relation about said rim structure so that spoil, in a digging operation, is alternately directed into said spoil receiving section at opposite sides of said ring member.

* * * * *